US007120963B2

(12) United States Patent
Kim

(10) Patent No.: US 7,120,963 B2
(45) Date of Patent: Oct. 17, 2006

(54) PAINT ROLLER MOUNTING ASSEMBLY

(76) Inventor: Song Kim, 2312 Via Pinale, Palos Verdes Estates, CA (US) 90274

( * ) Notice: Subject to any disclaimer, the term of this patent is extended or adjusted under 35 U.S.C. 154(b) by 738 days.

(21) Appl. No.: 10/449,323

(22) Filed: May 30, 2003

(65) Prior Publication Data

US 2004/0237241 A1 Dec. 2, 2004

(51) Int. Cl.
*B05C 1/00* (2006.01)
*B05C 17/02* (2006.01)

(52) U.S. Cl. ..... 15/230.11; 492/13; 492/19

(58) Field of Classification Search ..... 15/230.11; 492/13, 19
See application file for complete search history.

(56) References Cited

U.S. PATENT DOCUMENTS 2,891,301 A 6/1959 Conklin
3,060,555 A 10/1962 Kirshenbaum et al.
3,638,271 A 2/1972 Pharris et al.
3,877,123 A 4/1975 Pharris
4,985,959 A 1/1991 Lieberman et al.
5,210,899 A 5/1993 Goldstein et al.
5,269,039 A 12/1993 Isaac
5,619,769 A 4/1997 Hutt
5,795,279 A 8/1998 Shieh
6,256,828 B1 7/2001 Sauer

*Primary Examiner*—David Redding
(74) *Attorney, Agent, or Firm*—Borliner & Associates

(57) ABSTRACT

A unique paint roller mounting assembly, adapted for receiving a shaft of a small diameter paint roller handle which comprises an outer cylinder, upon which the paint roller is mounted and an end piece which is inserted into the outer cylinder. The end piece has a first and second inner chamber wherein the first chamber is adapted for receiving the paint roller handle and the second chamber retains a split bushing which also receives the paint roller handle. The length of the outer cylinder does not vary the length of the end piece. The mounting assembly is very stable and is particularly adapted for use with smaller rollers.

7 Claims, 1 Drawing Sheet

FIG. 1
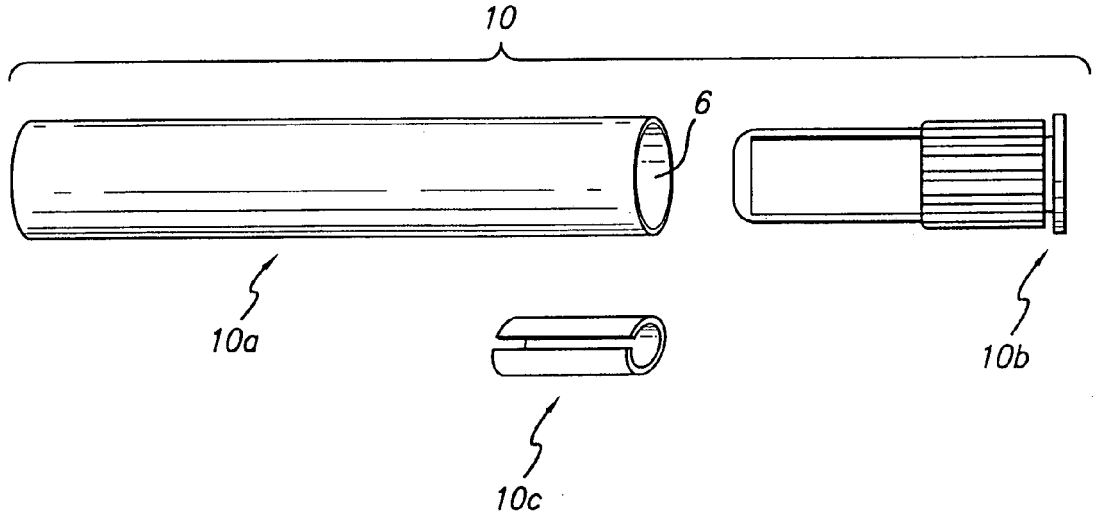
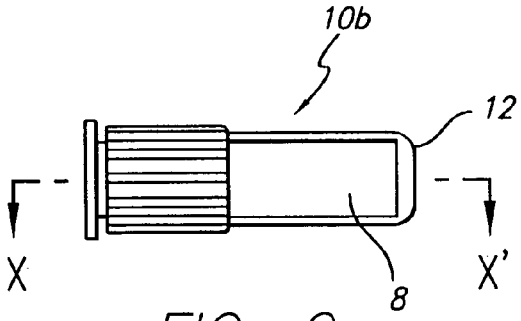
FIG. 2
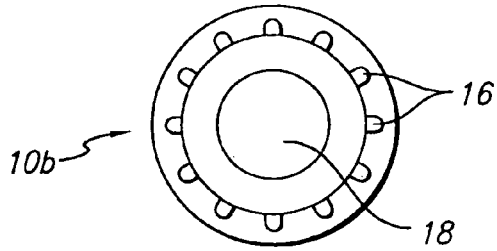
FIG. 3
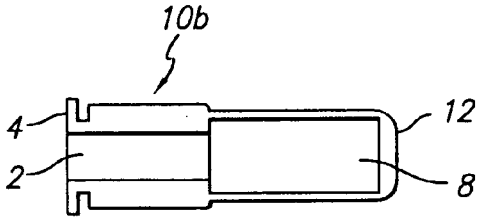
FIG. 4
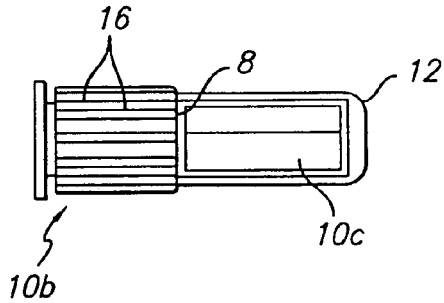
FIG. 5

PAINT ROLLER MOUNTING ASSEMBLY

FIELD OF THE INVENTION

The present invention relates generally to an apparatus for painting and in particular to a paint roller mounting assembly having a single length end piece which retains a single bushing.

BACKGROUND OF THE INVENTION

Currently, small diameter paint rollers of varying length require the use of end pieces of varying length. Long cylinders, upon which the paint roller is mounted, require the use of long end pieces having a bushing located in between the end pieces. Therefore, different molds of varying length must be used to make the end pieces. Thus, for a longer paint roller cylinder, a greater amount of material must be used to make the end piece and a number of different sized molds must be used to manufacture the end pieces.

The U.S. patent to Lieberman et al., U.S. Pat. No. 4,985,959 discloses, in FIGS. 1 and 3–5, end supports for a paint roller assembly. Lieberman discloses a split tube/cylinder adapted to receive the metal wire of a paint roller handle and retained by end supports. However, Lieberman also discloses at least two end supports having peripheral flanges and reinforcing webs. In addition, Lieberman requires a washer or flange to be disposed on the wire metal of the paint handle to act as a stopper for the paint roller.

The U.S. patent to Isaac U.S. Pat. No. 5,269,039, in FIGS. 2–5, discloses a sectional paint roller having an end piece that surrounds a split sleeve which acts as a bushing. However, the bushing of Isaac is only retained by the end piece after either an extension is inserted into the end piece or after an end cap is inserted into the end piece.

The U.S. patent to Goldstein U.S. Pat. No. 5,210,899 discloses a paint roller bearing, seen in FIGS. 1, 5, 7, and 9, having a series of offset or staggered outer semi-cylindrical surfaces that engage paint roller. At least one bushing loosely fits within the confines of once of the cylindrical chambers of the bearing and clamps around the metal wire of the paint handle. However, Goldstein discloses a separate end cap to the bearing and the bushing can easily fall out of the cylindrical chambers.

The previous devices do not provide for stable paint roller mounting assembly for use with small diameter, between 0.25 and 1.0 inch, outer cylinder having a single length end piece retaining a single bushing. The prior art patents comprise elements that would be thin and unstable if made in for smaller diameter paint rollers and would require longer end pieces for longer outer cylinders upon which the paint roller is mounted.

SUMMARY OF THE INVENTION

The present invention provides for a paint roller mounting assembly, which is adapted for receiving a shaft or metal wire of a paint roller handle. The paint roller mounting assembly comprises three elements, namely: an outer cylinder; a single end piece which is inserted into and surrounded by the outer cylinder; and a split cylinder or bushing retained by the end piece. A shaft of a paint roller handle can be inserted into the end piece which has an internal channel and then through the retained split cylinder.

A preferred embodiment of the mounting assembly comprises an outer cylinder having a diameter of about 0.25 to 1.0 inches, upon which the paint roller is mounted, an end piece which is inserted into and surrounded by the outer cylinder, the end piece having a first chamber adapted for receiving the paint roller handle, typically a metal wire, the end piece having a second chamber; and a split bushing having an internal diameter less than the diameter of the metal wire of the paint roller handle, the bushing retained in the second chamber of the end piece whereby to rotate freely in the second chamber.

The advantage of the apparatus of the present invention is that the even if the length of the outer cylinder varies, only a single length end piece is required. The prior art requires a longer end piece be used in a longer outer cylinder, and thus separate molds must be used to manufacture the different length end pieces. In order to maintain stability, longer outer cylinders and longer end pieces mean more bushing are required. Thus the present invention discloses a single length end piece, which can be used in varying length outer cylinders and thus only requires a single mold be used to manufacture the end piece, which is cost effective.

Another advantage of the present invention is that the end piece and bushing of the present invention act as a sort of thrust bearing preventing lateral movement of the roller relative to the axle of the shaft of the paint handle, thus the assembly of the present invention allows for a smoother application of paint.

A further advantage of the present invention is the mechanism of simple insertion of the bushing into the end piece without deforming the bushing or end piece, yet allowing the bushing to freely rotate within the end piece.

These and other features, aspects, and advantages of the present invention will become better understood with regard to the following detailed description and accompanying drawings.

BRIEF DESCRIPTION OF THE DRAWINGS

FIG. 1 is an exploded side view of the paint roller mounting assembly, showing an outer cylinder, an end piece, and a split bushing;

FIG. 2 is a side view of the end piece of the paint roller holder;

FIG. 3 is a cross section view along the X–X' axis of FIG. 2, showing the thickness of the wall of the end piece;

FIG. 4 is a top view of the end piece of FIG. 2 and showing the opening through which the shaft of the paint handle is inserted; and FIG. 5 is a side view of the end piece of the paint roller holder retaining the bushing.

DETAILED DESCRIPTION OF THE INVENTION

In accordance with the present invention a paint roller mounting assembly is provided, adapted for smaller diameter paint rollers having a diameter of about 0.25 to 1.0 inches, preferably having an inner diameter of about 0.50 inches. Any commercially available paint roller can be mounted to the paint roller assembly of the present invention and any commercially available paint roller handle can be received by the mounting assembly.

With reference to FIGS. 1–5, the paint roller mounting assembly 10 comprises an outer cylinder 10*a* having an inner chamber 6 for inserting an end piece 10*b*. The end piece 10*b* retains a split bushing 10*c* (FIG. 1). The outer cylinder 10*a* and the end piece 10*b* are typically made of plastic, such as polypropylene, polyethylene, nylon, acetal, Kapetal, or m27. The outer cylinder 10*a* and the end piece

10*b* are preferably made from a material that has some rigidity so that when pressure is applied to the mounting assembly, the mounting assembly remains stable even when the outer cylinder has a small diameter, such as 0.25 to 1.0 inches.

The end piece 10*b* has a first inner chamber 2 adjacent a first end 4. The end piece 10*b* has a second inner chamber 8 adjacent a second end 12 (FIG. 3). The second inner chamber 8 has a diameter about the diameter of the split bushing 10*c*, such that the split bushing 10*c* can be easily inserted into the second inner chamber 8, yet remain retained by the second inner chamber 8 (FIG. 5). Thus, the split bushing 10*c* rotates freely within the inner chamber 8.

A conventional paint roller handle typically has a shaft or metal wire (not shown) for inserting into a paint roller mounting assembly. The shaft or metal wire preferably has a round cross-section, although a strong plastic may be substituted for the metal. The end piece 10*b* is inserted into the outer cylinder 10*a* of the mounting assembly 10. A shaft of a paint roller handle (not shown) is inserted into the first inner chamber 2 of the end piece 10*b* of the mounting assembly 10, the first inner chamber 2 having a diameter about the size of the diameter of the shaft of the paint roller holder. The shaft then passes through the split bushing 10*c*, which has previously been inserted into the second inner chamber 8 of the end piece 10*b* of the mounting assembly 10. The shaft thus passes through the second inner chamber 8 of the end piece 10*b*. If the shaft is longer than the end piece 10*b*, it then passes through the inner chamber 6 of the outer cylinder 10*a*.

The first end 4 of the end piece 10*b* has an outer diameter greater than the outer cylinder 10*a* which acts as a stop block preventing the end piece 10*b* from being completely inserted into the outer cylinder 10*a*. The outer surface of the first inner chamber 2 of the end piece 10*b* has a plurality of ridges 16 that contact the inner surface 6 of the outer cylinder 10*a* and help to retain the end piece 10*b* once inserted into the outer cylinder 10*a*, while allowing the end piece 10*b* to be freely rotatable with respect to the outer cylinder 10*a* (FIGS. 4 and 5).

Although the foregoing invention has been described in some detail by way of illustration and example for purpose of clarity and understanding, it will be obvious that various modifications and changes which are within the knowledge of those skilled in the art are considered to fall within the scope of the appended claims.

The invention claimed is:

1. A paint roller mounting assembly, adapted for receiving a shaft of a paint roller handle comprising:

an outer cylinder, upon which the paint roller is mounted;

an end piece which is inserted into and surrounded by the outer cylinder, said end piece having first and second interior chambers wherein said first chamber is adapted for receiving said shaft; and a split bushing retained in said second chamber by the end piece.

2. The paint roller mounting assembly of claim 1, said outer cylinder having a diameter of about 0.25 to 1.0 inches.

3. The paint roller mounting assembly of claim 2, wherein the outer cylinder has a diameter of about 0.5 inches.

4. The paint roller mounting assembly of claim 1, wherein said end piece further comprises a plurality of projections on the outer surface of said first chamber, whereby said projection retain the end piece in the outer cylinder once the end piece is inserted into the outer cylinder.

5. A paint roller mounting assembly, adapted for receiving a shaft of a paint roller handle comprising:

an outer cylinder having a diameter of about 0.25 to 1.0 inches, upon which the paint roller is mounted;

an end piece which is inserted into and surrounded by the outer cylinder, said end piece having a first interior chamber adapted for receiving said shaft and said end piece having a second interior chamber; and a split bushing having an internal diameter less than the diameter of the shaft of the paint roller handle, said bushing retained in the second chamber of said end piece whereby to rotate freely in said second chamber.

6. The paint roller mounting assembly of claim 5, wherein the outer cylinder has a diameter of about 0.5 inches.

7. The paint roller mounting assembly of claim 5, wherein said end piece further comprises a plurality of projections on the outer surface of said first chamber, whereby said projection retain the end piece in the outer cylinder once the end piece is inserted into the outer cylinder.

* * * * *